United States Patent [19]

Baur et al.

[11] 4,209,124

[45] Jun. 24, 1980

[54] ROCK BIT ASSEMBLY METHOD

[75] Inventors: George W. Baur, Pasadena; Ross McKee, Houston, both of Tex.

[73] Assignee: Hughes Tool Company, Houston, Tex.

[21] Appl. No.: 923,835

[22] Filed: Jul. 12, 1978

Related U.S. Application Data

[63] Continuation of Ser. No. 773,100, Feb. 28, 1977, abandoned.

[51] Int. Cl.[2] ..... B23K 31/00; B23K 37/04

[52] U.S. Cl. ..... 228/182; 228/212; 228/4.1; 228/44.1 R; 29/281.1; 29/281.5

[58] Field of Search ..... 228/103, 182, 212, 213, 228/196, 4.1, 44.1; 175/375, 412; 219/121 EB, 121 EM; 29/559, 464, 281.1, 281.5; 76/108 A

[56] References Cited

U.S. PATENT DOCUMENTS

| | | | |
|---|---|---|---|
| 3,907,191 | 9/1975 | Lichte | 29/464 |
| 3,987,859 | 10/1976 | Lichte | 175/375 |
| 4,054,772 | 10/1977 | Lichte | 175/375 |
| 4,098,448 | 7/1978 | Sciaky et al. | 228/103 |

*Primary Examiner*—Daniel C. Crane
*Attorney, Agent, or Firm*—Robert A. Felsman

[57] ABSTRACT

A method for assembling rock bit sections in preparation for welding in a manner to assure dimensional integrity. Involved in the method is the use of a clamping fixture that has locator dowels and dowel holes on a base. These locator means are used in combination with a fixed position ring gage, determining the selected diameter of the assembled rock bit, to establish accurate alignment of the sections for clamping and welding. The fixed ring gage and locator means accurately position the sections relative to each other to minimize pre-assembly slippage between the sections.

3 Claims, 1 Drawing Figure

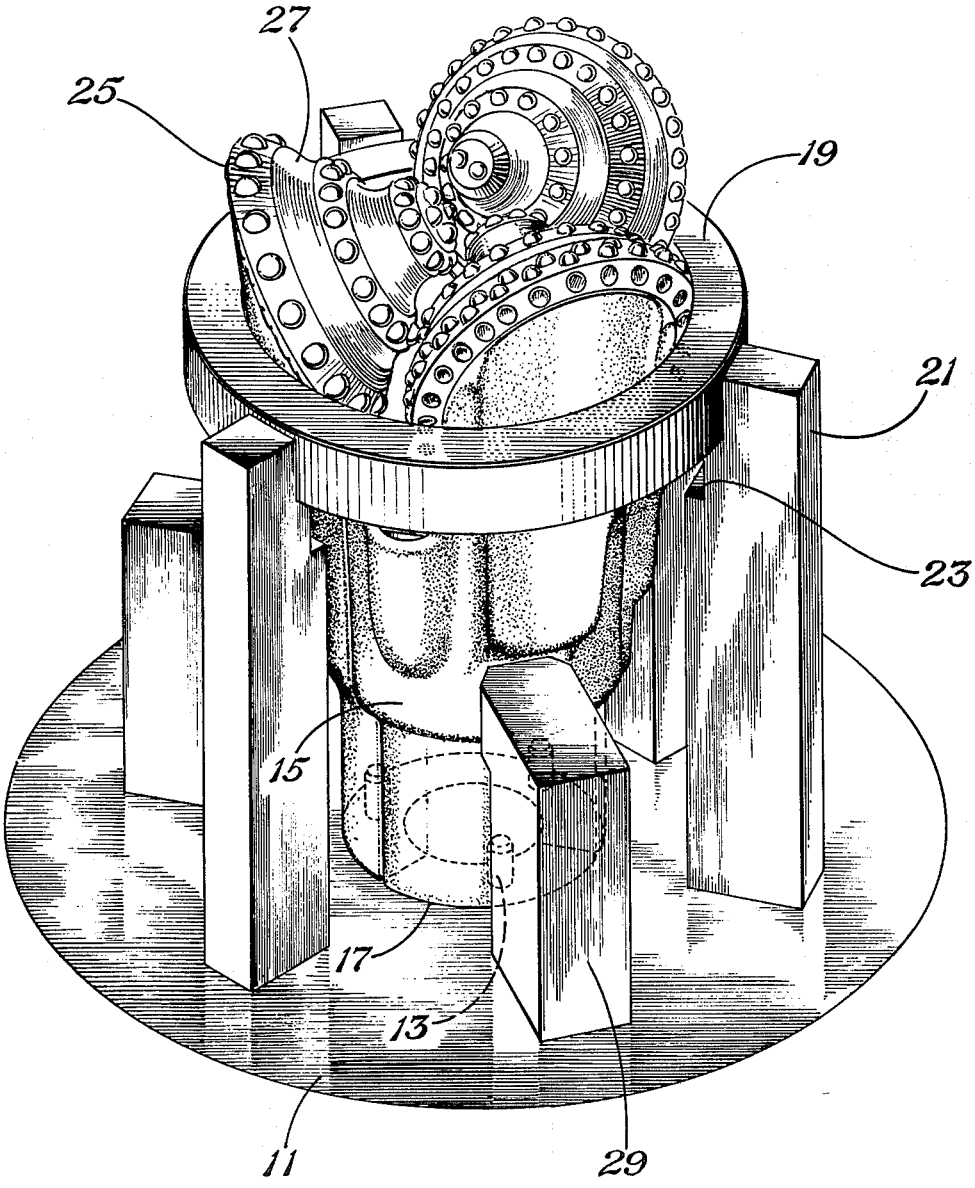
27
25
19
21
23
15
17
13
11
29

ROCK BIT ASSEMBLY METHOD

CROSS REFERENCE TO RELATED APPLICATIONS

This is a continuation of application Ser. No. 773,100, filed Feb. 28, 1977, now abandoned.

BACKGROUND OF THE INVENTION

1. Field of the Invention:

This invention relates in general to improvements in rock bit assembly, and in particular to methods for assembling and holding rock bit sections in preparation for welding.

2. Description of the Prior Art:

A common prior art method of assembling rock bit sections in preparation for welding used dowel holes and dowels positioned between the abutting faces of the sections. This technique assured accurate vertical and radial alignment of the sections. If all parts of the pre-assembled rock bit were within dimensional tolerances, the bit diameter would be within tolerance after clamping and welding.

If rock bits were assembled in the above manner and failed to be within bit diameter tolerance, corrective measures were necessitated unless the bit was to be scrapped. One corrective measure involved removal of the dowels, scissoring the section faces relative to one another, then clamping the sections and welding them. U.S. Pat. No. 3,907,191 issued to Dresser Industries, Inc. This patent discloses the use of the non-dowel and scissoring technique for reaching acceptable bit gage diameter. This technique has the disadvantage of allowing loss of dimensional integrity. A rock bit must have dimensional integrity or else its performance may be severely restricted. Unequal loading of the sections and associated cutters results from inaccurate vertical alignment. Excessive scissoring of the sections causes the centerlines of the cutters to become aligned in a manner outside the original design parameter. Such variations lead to unpredictable performance and are to be avoided to achieve the highest quality and consistent performance.

SUMMARY OF THE INVENTION

The present invention assures dimensional integrity of assembled rock bits by use of a fixture and method that utilize locator dowels on a fixed base in combination with a ring gage of fixed position above the dowels. The unassembled sections of a rock bit are inserted through the ring until the locator dowel holes in the shank ends mate with the dowels of the base. The rotatable cutter pre-assembled on each section or a portion of each section is positioned against the ring gage. When all the sections are thus assembled, clamping means urge the sections together and hold them until welding.

BRIEF DESCRIPTION OF THE DRAWING

FIG. 1, the sole FIGURE of the drawing, is a perspective view of the preferred fixture used to practice the disclosed method.

DESCRIPTION OF THE PREFERRED EMBODIMENT

The numeral 11 of the drawing designates the base of a fixture, with three locator dowels 13 in a circular pattern (i.e., equal radii from the centerline of the assembled bit) and extending upwardly from the base. Sections 15 (three in the most common type rock bit) have dowel holes mating with the dowels 13 as locator means to retain the shank end 17 of the sections in fixed equal vertical and radial positions.

A ring gage 19 on equally spaced supports 21 of the base is positioned concentrically above the dowels 13. This ring has an interior surface that establishes the selected gage diameter of the bit and is preferably removable from the supports 21 to enable differing sizes of rings to be lodged on the shoulders 23 for assembling differing sizes of bits. Each section 15 is lowered through the ring until the dowels 13 and dowel holes are mated. The gage surface 25 of each pre-assembled cutter 27, or a designated part of each section, is positioned against the ring gage. Then the equally spaced clamping jaws 29 are urged inwardly by suitable prior art means (not shown) to clamp the sections such that their mutually opposing (120°) faces are forcibly joined. The sections are then welded and the clamping jaws released. The welded sections can then be removed from the fixture.

The invention has significant advantages in that the use of the dowels of the base and dowel holes in the shank ends of the section when coupled with the use of a fixed position concentric ring assures more accurate alignment of the sections. Hence the dimensional relationship between the sections is controlled and slippage minimized. The original design parameters are better maintained. Thus quality and performance of the rock bit will be consistent.

We claim:

1. A method for assembling rock bit sections prior to welding to assure alignment of their shank ends and their cutter ends, said method comprising the steps of:

forming a substantially cylindrical and vertical dowel hole in the shank end of each section to be welded;

assembling rotatable cutters on the cutter ends of said section;

locating the substantially cylindrical and vertical dowel hole of the shank end of each section on a dowel in the base of a fixture to establish the relative positions of the shank ends and essentially prevent radial motion, said sections being positioned in a ring gage of predetermined diameter in a fixed position concentrically above the dowels;

positioning the cutters of each section against the ring gage which engages said cutters to minimize slippage of the sections;

clamping the sections with the sections and cutters thus positioned;

welding said sections while clamped; and removing the welded sections from the ring gage and dowels.

2. A method for assembling rock bit sections prior to welding to assure alignment of their shank ends and their cutter ends, said method comprising the steps of:

forming a positioner hole in the shank end of each section to be welded;

assembling rotatable cutters on the cutter ends of said sections;

locating the positioner hole of the shank end of each section on a dowel in the base of a fixture to establish the relative positions of the shank ends and essentially prevent radial motion, said sections being positioned in a ring gage of predetermined diameter positioned concentrically above the dowels in a fixed position;

positioning the cutters of each section against the ring gage which engages said cutters to minimize slippage;

clamping the sections with the sections and cutters thus positioned;

welding said sections while clamped; and removing the welded sections from the ring gage and dowels.

3. A method for assembling rock bit sections prior to welding to assure alignment of their shank ends and their cutter ends, said method comprising the steps of:

forming positioner means operable on the shank ends of the sections to be welded;

assembling rotatable cutters on the cutter ends of said sections;

locating the positioner means of the shank end of each section on mating means in the base of a fixture to establish the relative positions and essentially prevent radial motion, said sections being in a gage of predetermined dimension concentrically above the mating means in a fixed position;

positioning each section and cutter combination against the gage to minimize slippage;

clamping the sections with the sections and cutters thus positioned;

welding said sections, while clamped; and removing the welded sections from the gage and mating means.

* * * * *